US005490302A

United States Patent [19]

Dion

[11] Patent Number: 5,490,302

[45] Date of Patent: Feb. 13, 1996

[54] DETACHABLY MOUNTED BACK WASHER WITH INFLATABLE BLADDER

[76] Inventor: William D. Dion, 7126 S. Shadow Cove, Salt Lake City, Utah 84121

[21] Appl. No.: 352,571

[22] Filed: Dec. 9, 1994

Related U.S. Application Data

[63] Continuation-in-part of Ser. No. 238,387, May 5, 1994.

[51] Int. Cl.[6] ..... A47K 7/02

[52] U.S. Cl. ..... 15/210.1; 15/244.1; 15/247; 4/606

[58] Field of Search ..... 15/209.1, 210.1, 15/247, 244.1; 4/605, 606

[56] References Cited

U.S. PATENT DOCUMENTS

| | | | |
|---|---|---|---|
| 3,055,037 | 9/1962 | Fjelstad | 15/210.1 |
| 3,750,226 | 8/1973 | Morgan | 4/606 |
| 4,184,221 | 1/1980 | Edwards | 15/210.1 |
| 4,696,068 | 9/1987 | Kenner | 4/606 |
| 4,704,759 | 11/1987 | Mesa | 15/160 |
| 4,890,352 | 1/1990 | Stowers et al. | 4/606 |

*Primary Examiner*—Edward L. Roberts, Jr.
*Attorney, Agent, or Firm*—Snow, Christensen & Martineau

[57] ABSTRACT

A wall mounted back washer and applicator which may be used to wash, massage, or to apply lotion or salve to the back of the human torso without assistance. The device includes a foam pad mounted to a rigid plate which contains a plurality of suction cups for demountably attaching to any wall surface. In the alternative, the foam pad may be replaced by or used in conjunction with an inflatable bladder 40 which is inflated or deflated according to the user's desires for a rougher or softer application surface. The size of the device accommodates for the use of any standard size wash cloth. Fabric of equal or larger size and thickness can be used with the device.

9 Claims, 4 Drawing Sheets

DETACHABLY MOUNTED BACK WASHER WITH INFLATABLE BLADDER

This invention is a continuation-in-part of co-pending U.S. patent application Ser. No. 08/238,387, filed on May 5, 1994.

BACKGROUND OF THE INVENTION

1. Field of the Invention

This invention relates to the field of personal grooming devices and more particularly to a detachably mounted back washer and applicator device of a configuration which utilizes a standard wash cloth and includes an inflatable bladder to vary the applicator surface.

2. The Present State of the Art

The present invention was developed to fill a need for persons who desire a detachably mounted back washer and applicator which utilizes a standard wash cloth. Further, the present invention was developed to allow the user of the invention to selectively vary the application surface according to desire.

Various devices for attachment to a bathroom shower or tub wall presently exist for the purpose of cleaning or massaging inaccessible areas of a person's body. Such devices assist the elderly, persons with arthritis and others with impaired mobility. Otherwise unimpaired persons also benefit from the presently known devices which make hard-to-reach areas of a persons back side accessible to cleaning or massaging.

Detachably mounted back washers presently known require a customized cloth cover which would be jointly used by multiple users. Applying the foregoing design approach, certain sanitation problems have been encountered. For instance, a person with a skin allergy easily transmits the condition to other users of presently known devices requiring a customized cloth cover.

In addition to the lack in the prior art of a detachably mounted back washer which utilizes a standard wash cloth, there also exists no back washer which allows the user to vary the surface of application. For example, some people have sensitive skin and may enjoy a softer application surface in order to not irritate that skin. On the other hand, some people have less sensitive skin which may enjoy a vigorous scrubbing with a rougher application surface.

There remains a need to provide a more satisfactory solution for persons desiring a detachably mounted back washer and applicator.

SUMMARY OF INVENTION

The present invention seeks to resolve a number of the problems which have been experienced in the prior art, as identified above. More specifically, the apparatus and method of this invention constitute an important advance in the art of detachably mounted back washers and applicators as evidenced by the following objects and advantages realized by the invention over the prior art.

One object of the present invention is to eliminate the need for a customized wash cloth cover.

A further object of the present invention is to provide for sanitary use for multiple users of the device.

Additionally, it is an object of the present invention to be utilized for application of oils, lotions or salves.

Yet another object of the present invention is to provide a back washer in which a standard wash cloth may be used for color coordination with other bathroom linen.

A further object of the present invention is to allow users to use the same wash cloth on the back washer as is being used for bathing or showering purposes.

Another object of the present invention is to provide a means whereby the device may be detachably mounted to a wall with seams, such as grout lines from tiles which impede the attachment by suction cups.

Still another object of the present invention is to provide a detachably mounted back washer including an application surface which can be selectively varied by the user according to desire.

A still further object is to provide an inflatable bladder to vary the tautness of the wash cloth while decreasing the storage space necessary for transport.

Additional objects and advantages of the invention will be apparent from the description which follows, or may be learned by the practice of the invention.

Briefly summarized, the foregoing objects are achieved by an apparatus which comprises a water resistant and resilient pad of rectangular shape, a substantially rigid mounting plate which is secured to the resilient pad and a plurality of suction cups in staggered rows located on the underside of the plate for detachably mounting the back washer to a wall. The plate includes gripper ribs around the perimeter of the underside of the plate for securing a standard-sized wash cloth over the resilient pad when attached to a wall.

Another preferred embodiment of the present invention is identical to that just described except that the rectangular shaped pad is replaced with an inflatable bladder to vary the tautness of the wash cloth surface, and thereby vary the roughness of the application. The bladder includes a small diameter air hose leading from the bladder to a hand-held inflator. Alternatively, the bladder may be inflated by the user to the desired tautness by blowing into the air hose and capping the free end with a cap. It is also within the purview of this invention to use the pad and bladder together.

BRIEF DESCRIPTION OF DRAWINGS

In order to more fully understand the manner in which the above-recited advantages and objects of the invention are obtained, a more particular description of the invention will be rendered by reference to specific embodiments thereof which are illustrated in the appended drawings. Understanding that these drawings depict only typical embodiments of the invention and are therefore not to be considered limiting of its scope, the presently preferred embodiments and the presently understood best mode of the invention will be described with additional detail through use of the accompanying drawings in which.

DESCRIPTION OF THE PREFERRED EMBODIMENT

Figure 1:
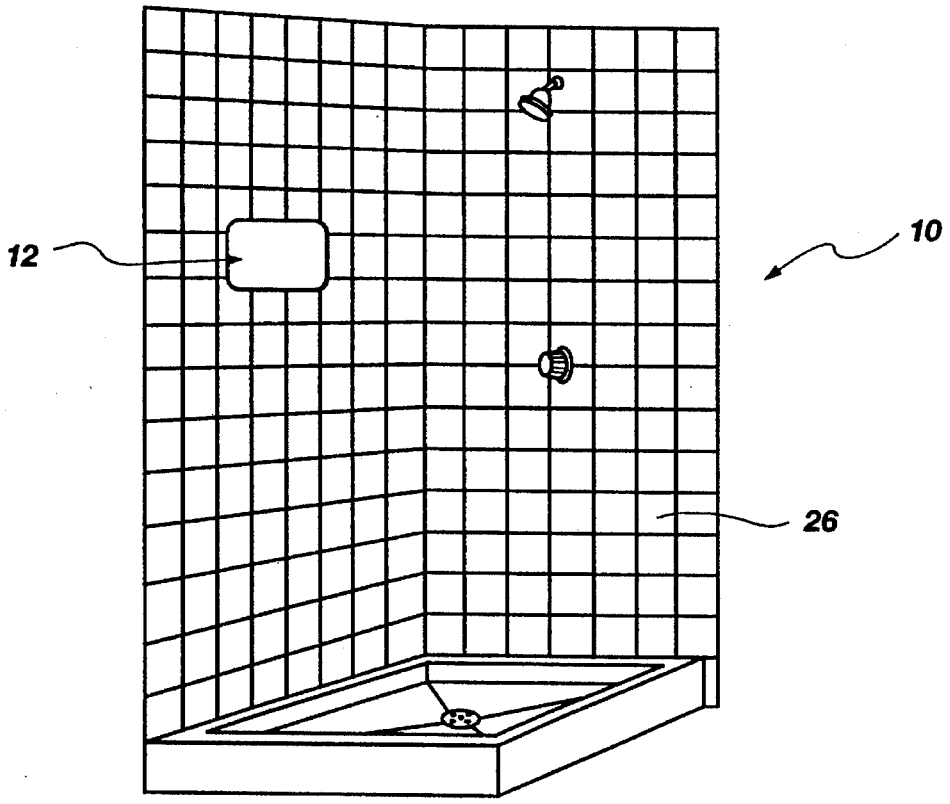
FIG. 1 is a perspective view of the preferred embodiment of a detachably mounted back washer and applicator incorporating teachings of the present invention.
Figure 2:
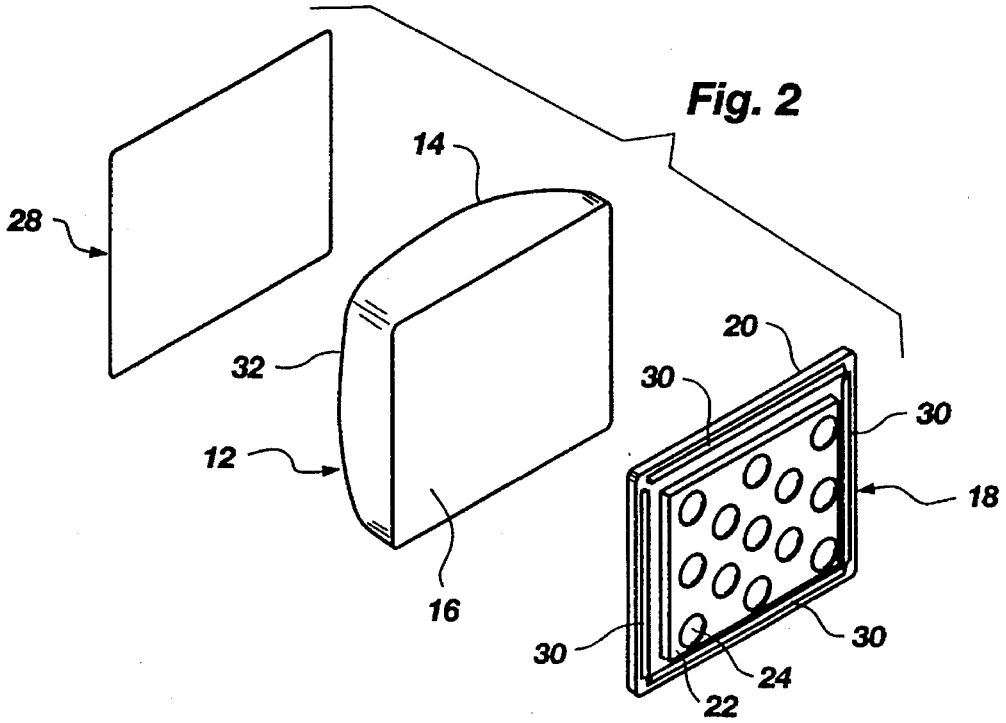
FIG. 2 is a group view of the present invention.
Figure 3:
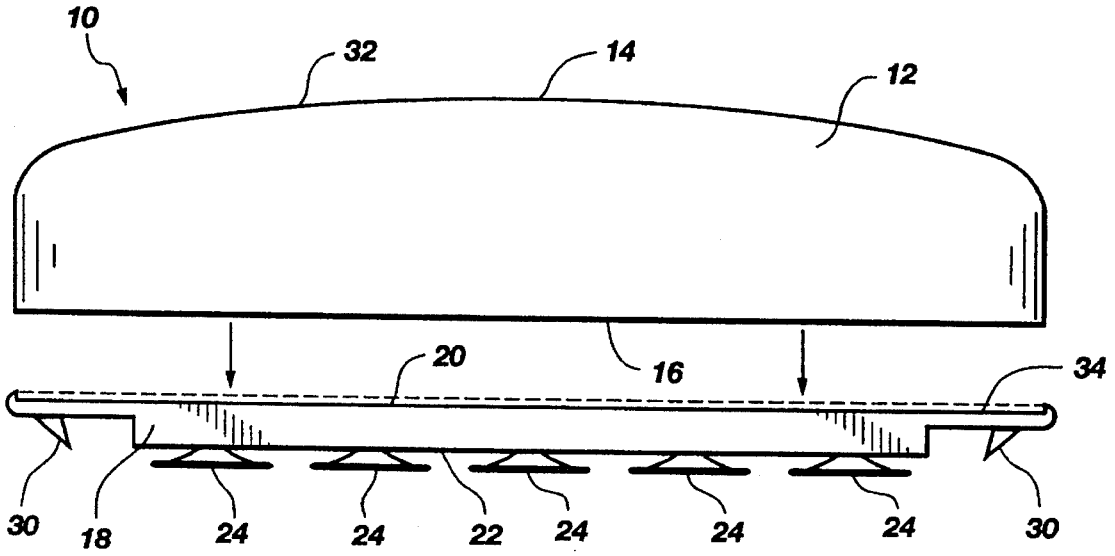
FIG. 3 is a side view of the present invention shown in FIG. 1 with the foam pad detached from the plate.
Figure 4:
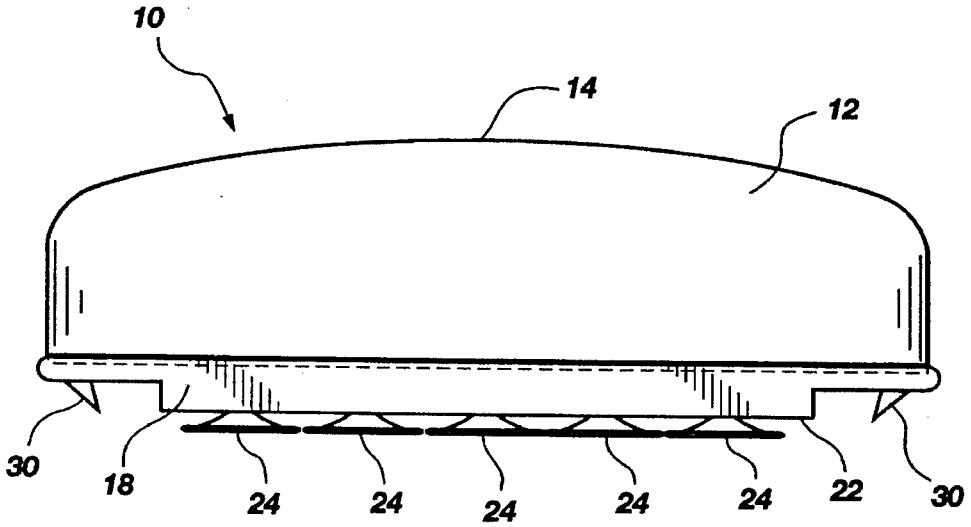
FIG. 4 is an end view of the present invention shown in FIG. 1.

In the form illustrated, the detachably mounted back washer and applicator 10 comprises a water resistant and resilient pad 12 of rectangular shape which is secured to a substantially rigid mounting plate 18. The pad 12 has a curved top side 14 and a flat bottom side 16 which is adapted to be attached to the upper side 20 of the plate 18. In the alternative, rather than a resilient pad, an inflatable bladder 40 is included, the bladder 40 including a top side 42 and a flat bottom side 44 which is adapted to be attached to the upper side 20 of the plate 18.

The underside 22 of the plate 18 contains a plurality of suction cups 24 for attaching the back washer and applicator 10 to a wall surface 26 of a shower or tub as illustrated in FIG. 1. However, the back washer and applicator 10 may also be attached to any wall surface.

As discussed previously, an important feature of the back washer and applicator 10 is the ability to utilize a standard-sized wash cloth 28, of approximately 12 to 13 inches in length and approximately 12 to 13 inches in width. Detachably mounted back washers presently known require a customized cloth cover, thereby leading to sanitation problems for multiple users such as the transmission of a skin allergy. The back washer and applicator 10 provides for the use of any standard-sized wash cloth 28 which allows multiple users to use their own personal wash cloth. Moreover, the back washer and applicator 10 eliminates the need for a customized cloth cover such as those required by the devices taught in U.S. Pat. Nos. 4,696,068 and 3,750,226.

Figure 5:
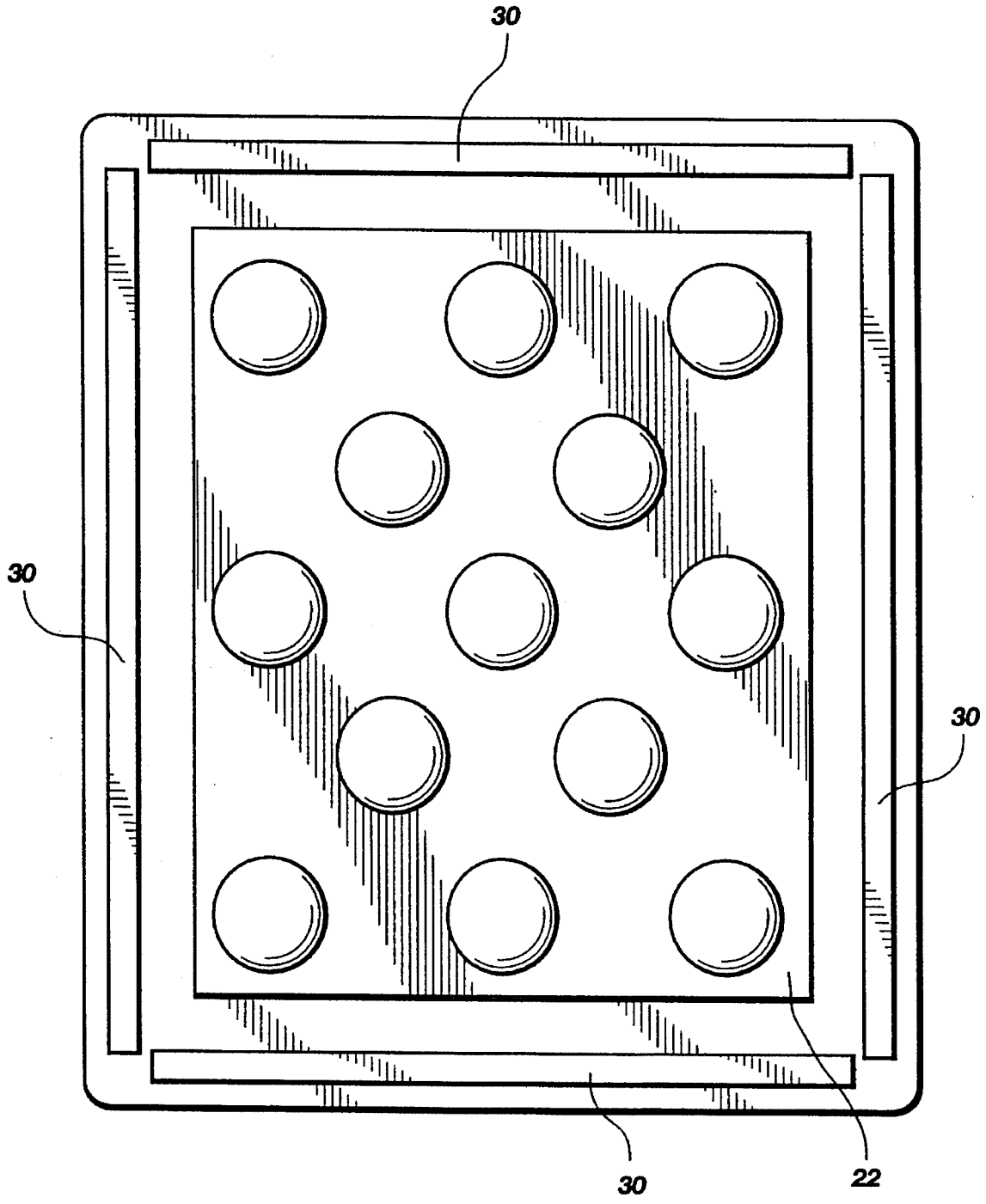
FIG. 5, is a rear view of the present invention shown in FIG. 1.

A standard-sized wash cloth 28 is secured to the back washer and applicator 10 by means of continuous gripper ribs 30 located along the perimeter of the underside 22 of the plate 18 as shown in FIG. 5. One skilled in the art will recognize that the gripper ribs 30 must be continuous in order to provide a homogeneously taut surface across the wash cloth 28, especially when the inflatable bladder 40 is used.

The back washer and applicator 10 must first be attached to a wall 26 in order for the gripper ribs 30 to secure the standard-sized wash cloth 28 over the resilient pad 12 or inflatable bladder 40. The perimeter of the plate 18 is then pulled away from the wall 26 while tucking the wash cloth 28 behind the gripper ribs 30. Any fabric of equal or larger size and thickness than a standard-sized wash cloth 28 may be used with the back washer and applicator 10.

The resilient pad 12 is made of a urethane foam that provides for flexibility and cushioning while applying soap, lotion or salve to the back of a human torso without assistance. The back washer and applicator 10 may also be used for massaging purposes. One skilled in the art will also recognize that any number of materials may be substituted for urethane foam which provide the same flexibility and cushioning characteristics.

Figure 6:
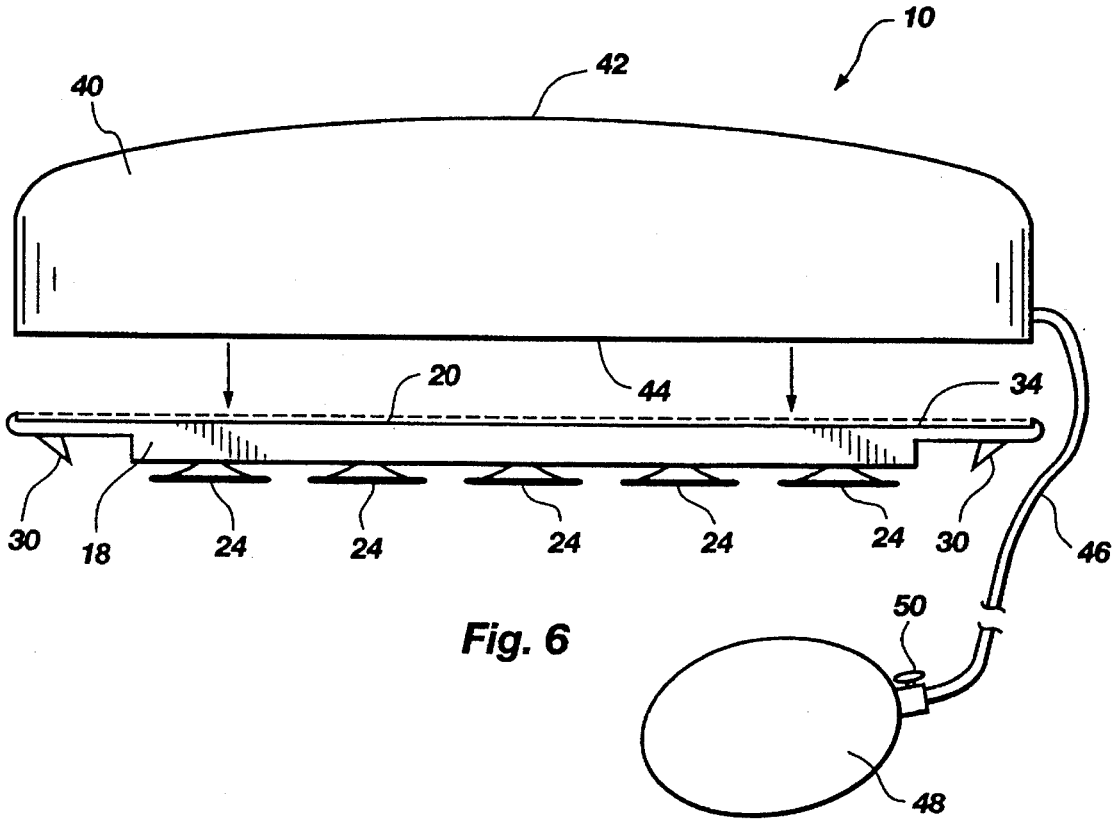
FIG. 6 is a side view of a second preferred embodiment of the present invention shown in FIG. 1 with the bladder detached from the plate.
Figure 7:
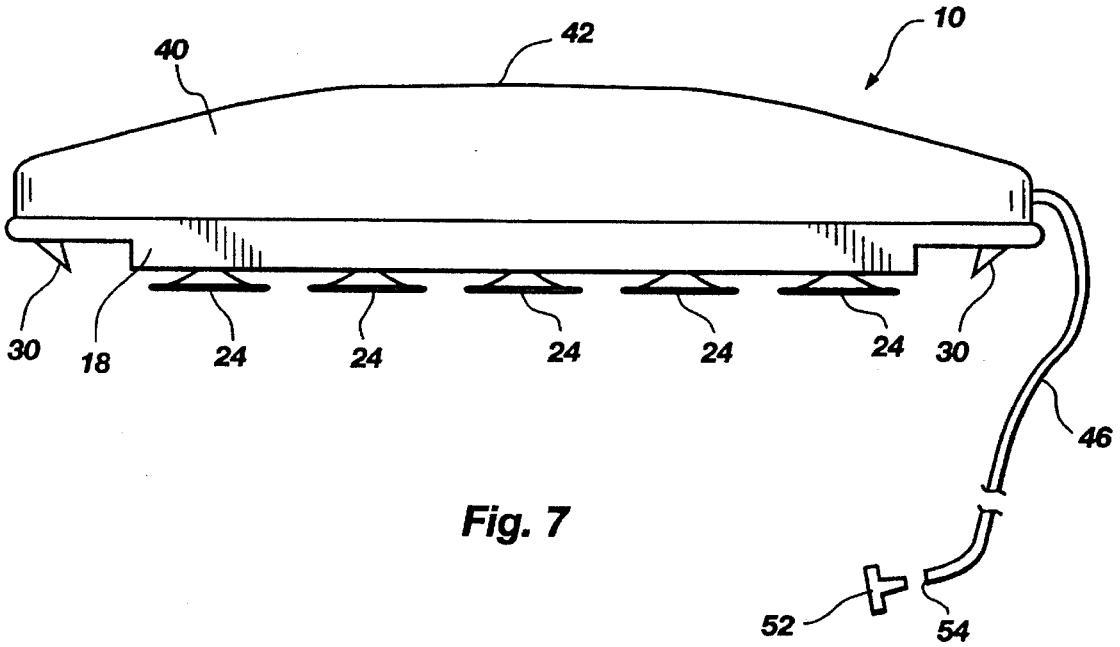
FIG.7 is an end view of the second preferred embodiment of the present invention shown in FIG. 1.

The inflatable bladder 40 is advantageously constructed of rubber or stretchable plastic, but one skilled in the art will know that any material which can be stretched but which also provides some structural integrity can be used. As shown in FIGS. 6 and 7, the bladder may be fully inflated (FIG. 6) or less than fully inflated (FIG. 7), dependent upon the desired tautness or surface roughness of the wash cloth 28.

Still referring to FIGS. 6 and 7, the bladder 40 includes a small diameter air hose 46 extending between the bladder 40 and the opposite end wherein air is inserted or released to inflate or deflate the bladder 40. FIGS. 6 and 7 illustrate two alternative apparatus for inflating and deflating the bladder 40. FIG. 6 shows a standard inflation/deflation bulb 48, which is commonly used with blood pressure measurement devices and the like. As illustrated, the bulb 48 includes a screw valve 50, which, when actuated, retains the air in the bladder 40. When deactuated, the air is released from the bladder 40 and the surface tautness decreases. Air is inserted into the bladder 40 by holding the bulb 48 in the palm of the hand and squeezing the bulb 48 several times, as desired.

FIG. 7 shows a simpler apparatus for inflating and deflating the bladder. It comprises an end cap 52 which fits in air tight fashion into the free end 54 of the air hose 46. In this manner, the user manually blows air into the bladder 40 through the open end 54 to inflate the bladder 40. The end cap 52 is then inserted into the end 54 to retain air in the bladder 40. Air is released from the bladder 40 by removing the end cap 52 from the end 54 of the air hose 46.

The back washer and applicator 10 requires strong adherence to a wall surface because of the forces applied during use. Early prototypes revealed that grout lines from a tile wall or other surfaces with seams in a tub or shower enclosure prevented the suction cups 24 from adhering to the wall 26. It was found that a larger number of small suction cups 24 provided greater adherence than fewer and larger suction cups 24. The preferred embodiment, as shown in FIG. 5, illustrates thirteen suction cups 24 of approximately one inch diameter in staggered rows. Placement of the suction cups 24 in staggered rows insures that sufficient adherence exists even if a number of the suction cups 24 are prevented from adhering due to grout lines or other surfaces with seams.

The preferred foam pad 12, over which a standard-sized wash cloth 28 is wrapped, is constructed of AQUAFLEX. It is in the family of water blown polyether or polyester type urethane wet pack systems. The foam pad 12 is open celled to allow for the change of temperatures that the back washer and applicator 10 may encounter. The foam pad 12 is made water-proof by spraying the reaction mold before molding with an aliphatic urethane coating.

The mounting plate 18 is made of injection molded, flexible poly-vinyl chloride, commonly known as PVC, or any other material which provides flexibility and sufficient rigidity. The upper side 20 of the mounting plate 18 includes a recessed area 34 for inserting the foam pad 12 or the inflatable bladder 40. The recessed area 34 ensures that the foam pad 12 or the bladder 40 does not separate from the mounting plate 18 while flexing of the four sides of the mounting plate 18 during attachment of the wash cloth 28. The foam pad 12 or inflatable bladder 40 is bonded to the mounting plate 18 with a water-resistant, temperature variable rolled or sprayed contact adhesive.

One skilled in the art will recognize that it is within the purview of this invention to combine the foam pad 12 and the inflatable bladder 40 for use within the same device. Either the bladder 40 or the pad 12 may be attached to the plate 18 while the other is contiguous with the wash cloth 28.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A wall mounted back washer and applicator comprising:

a substantially rigid mounting plate including upper and under broad surfaces;

a plurality of suction cups disposed on the under broad surface of the plate, the suction cups staggered in rows for detachably mounting the back washer to the wall;

a plurality of continuous gripper ribs inset around the perimeter of the under broad surface of the plate for securing a standard-sized wash cloth to the washer about its upper broad surface; and inflation and deflation means for selectively controlling the tautness of the wash cloth, the inflation and deflation means including an inflatable bladder securely attached to the upper broad surface of the plate.

2. A device as defined in claim 1, wherein the wash cloth is approximately 12 to 13 inches in length and approximately 12 to 13 inches in width.

3. A device as defined in claim 1, wherein the inflation and deflation means further includes an air hose leading from the bladder to an inflation and deflation apparatus.

4. A device as defined in claim 3, wherein the inflation and deflation apparatus includes an inflation/deflation bulb and screw valve.

5. A device as defined in claim 1, wherein the plate is comprised of flexible poly-vinyl chloride.

6. A wall mounted back washer and applicator comprising:

a water resistant and opened celled urethane foam pad of rectangular shape, said pad including a top and bottom side wherein the top side includes a curved surface, a substantially rigid mounting plate, said plate including an upper and under side wherein a plurality of suction cups in staggered rows are located on the underside of said plate for detachably mounting the back washer to a wall, said plate including gripper ribs for securing a standard-sized wash cloth, about the upper broad surface at the plate, the gripper ribs being inset around the perimeter of the underside of the plate, and an inflatable bladder disposed between the bottom side of the pad and the upper side of the plate, the bladder for selectively inflating and deflating the tautness of the wash cloth.

7. A device as defined in claim 6, wherein the gripper ribs are continuous along the perimeter of the underside of the plate.

8. A device as defined in claim 6, wherein the suction cups are one inch in diameter.

9. A device as defined in claim 6, wherein the bladder is recessed into the plate.

* * * * *